US006009734A

United States Patent [19]

Augustin et al.

[11] Patent Number: 6,009,734

[45] **Date of Patent: *Jan. 4, 2000**

[54] PROCESS AND DEVICE FOR MANUFACTURING HOLLOW SECTIONS WITH END-SIDE CROSS-SECTIONAL EXPANSIONS

[75] Inventors: Helmut Augustin, Hamburg; Henning Bloecker; Kai-Uwe Dudziak, both of Stelle; Uwe Hardtke, Neu Wulmstorf; Carsten Rogowski, Hamburg, all of Germany

[73] Assignee: DaimlerChrylser AG, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/975,364

[22] Filed: Nov. 20, 1997

[30] Foreign Application Priority Data

Nov. 20, 1996 [DE] Germany ..... 196480914

[51] Int. Cl.[7] ..... B21D 39/08

[52] U.S. Cl. ..... 72/58; 72/61

[58] Field of Search ..... 72/58, 61, 62, 72/709

[56] References Cited

U.S. PATENT DOCUMENTS

| | | | |
|---|---|---|---|
| 3,335,590 | 8/1967 | Early | 72/58 |
| 3,700,396 | 10/1972 | Adams | 91/449 |
| 4,418,556 | 12/1983 | Galle et al. | 72/62 |
| 4,635,466 | 1/1987 | Seki et al. | 72/453.13 |
| 4,730,474 | 3/1988 | Iwakura et al. | 72/61 |
| 4,738,814 | 4/1988 | Bowles et al. . | |
| 5,022,135 | 6/1991 | Miller et al. | 72/58 X |
| 5,097,689 | 3/1992 | Pietrobon | 72/58 |
| 5,233,864 | 8/1993 | Bowman et al. | 72/58 |
| 5,299,444 | 4/1994 | Kirii et al. | 72/453.13 |
| 5,396,786 | 3/1995 | Bartholomew et al. | 72/57 |
| 5,499,520 | 3/1996 | Roper | 72/58 |
| 5,630,334 | 5/1997 | Ash | 72/61 |
| 5,644,829 | 7/1997 | Mason et al. | 72/58 X |

FOREIGN PATENT DOCUMENTS

| | | |
|---|---|---|
| 0 439 764 A2 | 8/1991 | European Pat. Off. . |
| 44 44 759 A1 | 6/1996 | Germany . |
| 525 046 | 8/1972 | Switzerland . |

OTHER PUBLICATIONS

"Aufweitstauchen von Rohren durch Innenhockdruckumformen", F. Klaas, Apr. 4, 1988, 3 pages.

*Primary Examiner*—Joseph J. Hail, III
*Assistant Examiner*—William Hong
*Attorney, Agent, or Firm*—Evenson McKeown Edwards & Lenahan P.L.L.C.

[57] ABSTRACT

The invention relates to a process and apparatus for manufacturing hollow sections with cross-sectional expansions in end portions thereof. A hollow blank is widened and calibrated by internal high pressure forming by means of a forming tool receiving it, and, after the calibration, is separated in the area of the widening while forming two hollow sections with cross-sectionally widened ends facing one another in the separated position. In order manufacture from a hollow blank hollow sections with the lowest possible reject rate and therefore in a reliable process, which are cross-sectionally widened on the end side by means of high degree for forming, the blank is widened while the forming tool is open and is simultaneously upset to form a rotationally symmetrical bulging hollow section by means of a pressure force which is axially directed from the outside to at least one of the two blank ends.

20 Claims, 3 Drawing Sheets

PROCESS AND DEVICE FOR MANUFACTURING HOLLOW SECTIONS WITH END-SIDE CROSS-SECTIONAL EXPANSIONS

BACKGROUND AND SUMMARY OF THE INVENTION

This application claims the priority of German application number 196 48 091.4, the disclosure of which is expressly incorporated by reference herein.

The present invention relates to a process and apparatus for manufacturing hollow sections with cross-sectional expansions in end portions thereof.

A process and apparatus of the above-mentioned type are disclosed in German Patent Document DE 44 44 759 A1, which provides a process for manufacturing exhaust gas inlet stubs for motor vehicle catalysts. In that process, a pipe-shaped blank is placed in the sinking of a two-part internal high pressure forming tool, and the forming tool is closed. The sinking of each tool part has a projecting wedge-shaped recess which deviates from the axial longitudinal course of the blank shape. Each of the recesses has a uniform construction, but the two are arranged in a mirror-inverted manner, offset with respect to one another at an angle of rotation of 180° about a vertical axis. In the closed position of the forming tool, the blank and simultaneously the sinking are closed in a pressure-tight manner axially by two punches, each provided with a connection for introducing high pressure fluid. During expansion of the blank by the introduction of highly pressurized fluid, the punches push wall material of the blank into the recesses toward the center. The finished blank formed in this case has an asymmetrical construction in the expansion area corresponding to the shape of the sinking.

After the removal of the formed blank, it is divided by a separating device in the expansion area by a planar diagonal cut such that two hollow sections of an identical shape are produced whose ends, which face one another in the separated position, are widened in their cross-sections with respect to the remaining hollow-cylindrical course such that they have a diagonally extending funnel shape. The manufacturing of hollow sections with such high degrees of forming by means of the known process results in a high reject rate. That is, in the case of the construction of small radii at the expansion edges, even on one side of 90°, the required very high pressures of above 1,000 bar, and the high forming degrees (the ratio of the diameter of the inserted blank to the largest diameter of the formed component), of above 60%, despite the pushing by way of the follow-up punches, sufficient wall material cannot be supplied into the expansion area. Because of the small quantity of material occurring in this area, the wall of the blank partially becomes so thin, that the blank may burst. The suitable afterflowing of the wall material is prevented by the high friction on the sinking of the wall material pushed in by the punch despite the entering of a lubricant between the sinking and the blank.

It is an object of the invention to provide a process and apparatus of the above-mentioned type by which hollow sections can be produced from a hollow blank with the lowest possible reject rate and therefore in a reliable manner with respect to the process, which by means of high degrees of forming are widened on the end side in their cross-sections.

This and other objects and advantages are achieved by the method and apparatus according to the invention, in which high degrees of forming are permitted in a simple manner by the simultaneous widening by means of a fluid pressure and the axial pressing together of the blank caused by the closing movement of the forming tool which is open at the beginning of the forming operation. With respect to the high fluid pressure (>1,000 bar) required during the forming by a pure expansion, a comparatively low fluid pressure of approximately 200–300 bar must be applied. This also simplifies the fluid pressure generating system because the pressure intensifiers, which are required for very high pressures, are eliminated.

The coordination of the fluid pressure and the upsetting movement takes place such that a danger of buckling can virtually be excluded for the blank. Because of the upsetting, sufficient material is subsequently supplied into the expansion zone so that forming degrees of over 90% will even be possible without the occurrence of crack formations or even a destruction of the blank by bursting.

Since, during the forming process, no relative movement takes place between the blank and the sinking of the forming tool, no friction arises so that the customary lubrication will not be required. This has the result that no problems can occur during the reprocessing of the fluid pressure liquid as a result of filter clogging lubricants. The bulging, rotationally symmetrical blanks formed during the forming process can be easily separated by a simple cut transversely to their longitudinal dimension into two hollow sections.

Because of their rotational symmetry, these are optimally suitable for use as connection stubs for catalyst housings for the conventionally constructed housings, in which case, because of the straight cone of the hollow section according to the invention formed to such a stub, the best possible flow conditions against the catalyst body are ensured. Furthermore, because of the lower demands on a high forming capacity, the process according to the invention permits the use of rust-proof ferritic materials which in contrast to the previously used austenitic materials are significantly lower in price. Because of the lower thermal expansion in comparison to austenitic materials, the use of ferritic materials permits the manufacturing of more compact hollow sections or of assemblies which consist of these hollow sections or contain them.

Other objects, advantages and novel features of the present invention will become apparent from the following detailed description of the invention when considered in conjunction with the accompanying drawings.

DETAILED DESCRIPTION OF THE DRAWINGS

Figure 1:
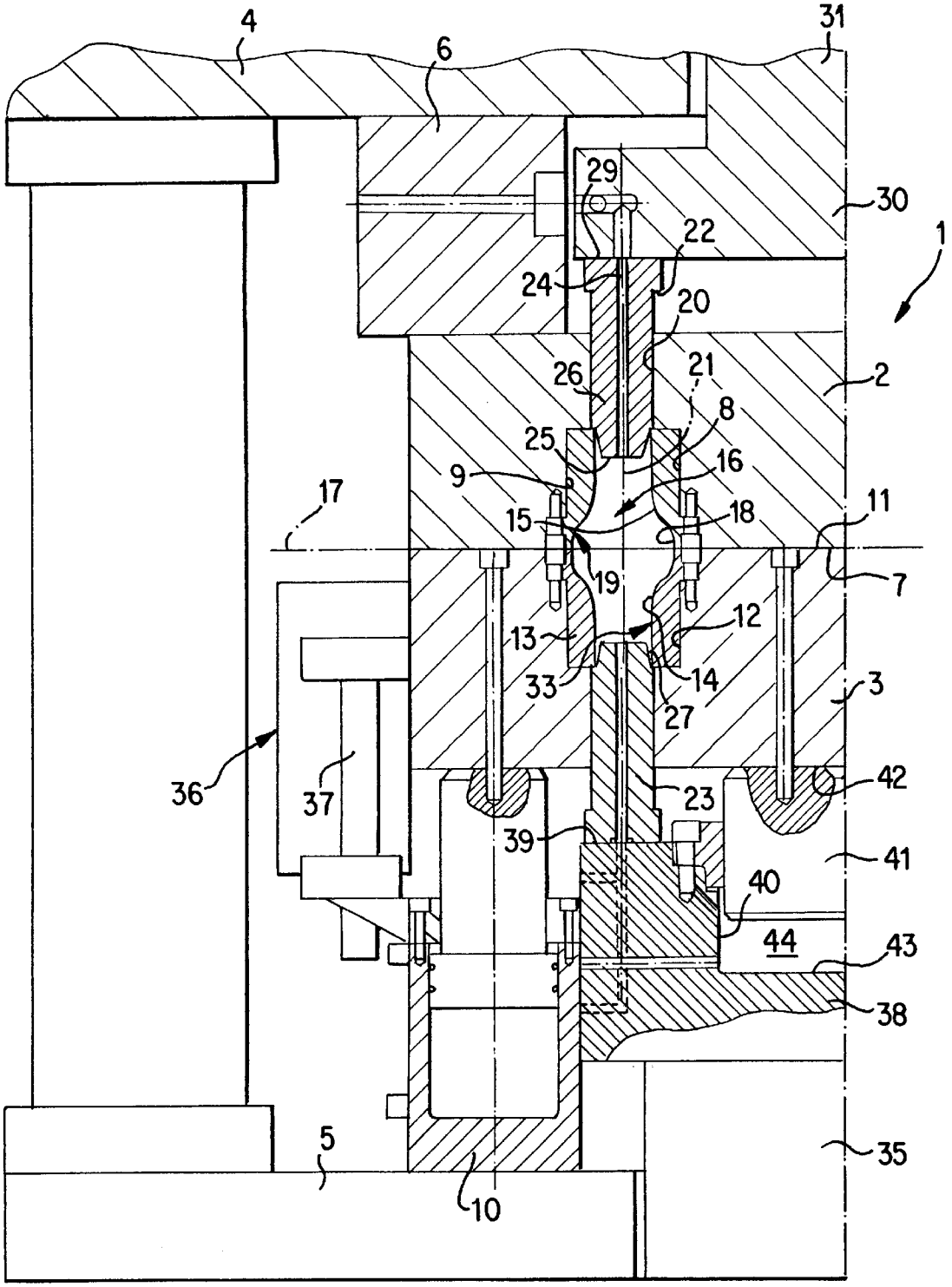
FIG. 1 is a lateral longitudinal sectional view of a section of the forming tool of the device according to the invention.
Figure 2:
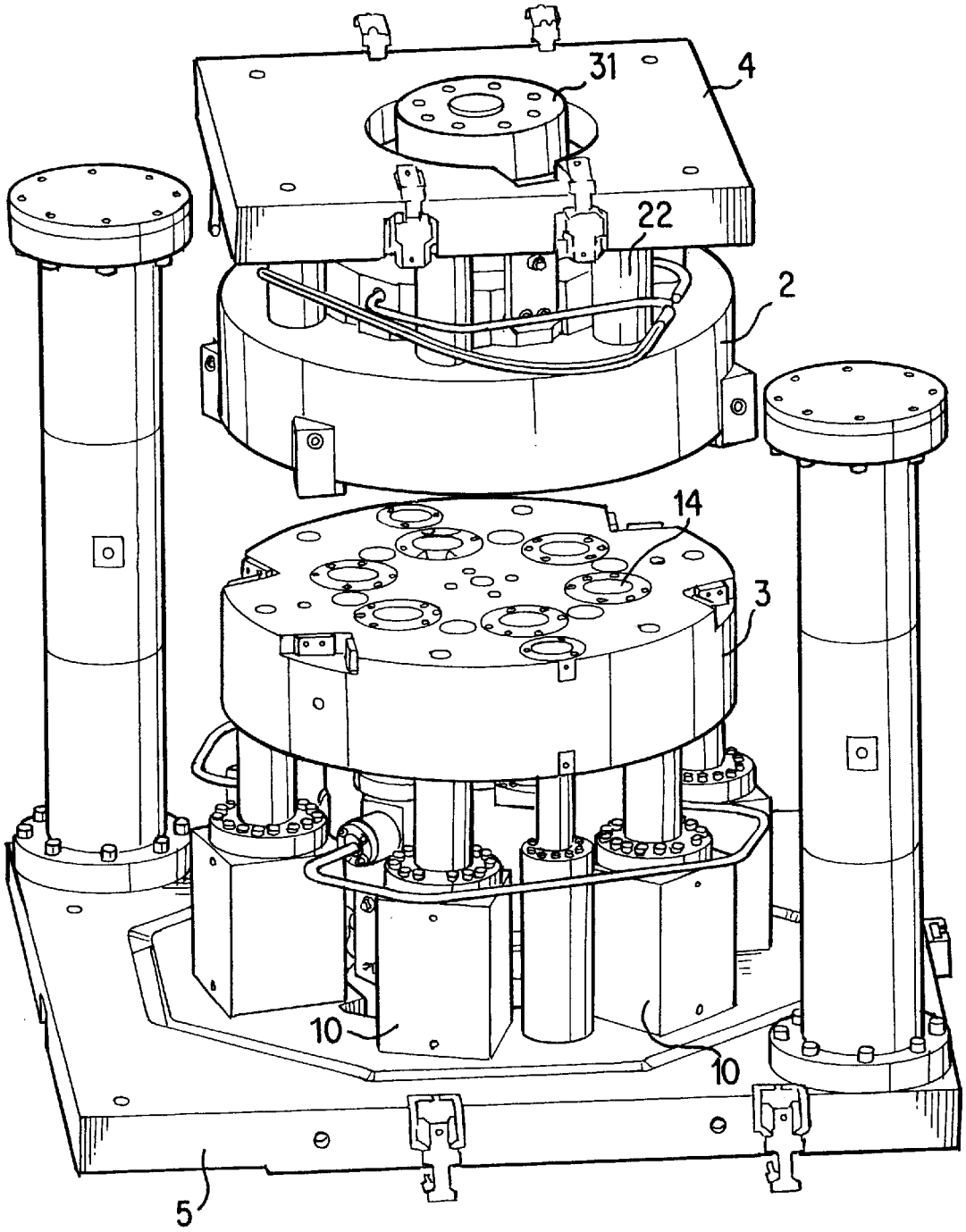
FIG. 2 is a perspective representation of the forming tool from FIG. 1.

As FIG. 2, FIG. 1 illustrates an internal high pressure forming tool 1 which consists of two tool halves, i.e., an upper half 2 and a lower half 3. The forming tool 1 is integrated in a forming press which contains a press slide 4 and a bedplate 5. By way of a head plate 6, the upper tool half 12 is fixedly connected with the press slide 4. Furthermore, it has a recess 8 on the face 7 facing away from the press slide, in which recess 8 an exchangeable upper die insert 9 is inserted and on face 7 is screwed to the tool half 2. The lower tool half 3 is connected with the bedplate 5 by way of several hydraulically operating driving cylinder 10 which are anchored there and which are arranged to be circularly distributed along the bottom side 42 of the lower tool half 3 and by which the lower tool half 3 can be movably driven to carry out strokes. In the face 11 of the lower tool half 3 facing the upper tool half 2, a recess 12 is constructed which has the same design as the recess 8 and in which a lower die insert 13 is placed and on the face 11 is screwed to the tool half 3.

The die inserts 9, 13 each have hollow sinking parts 14 and 15 which axially penetrate the inserts 9, 13 and which, when resting against one another, form a common rotationally symmetrical sinking 16. With respect to the horizontally extending separation plane 17 of the forming tool 1, the two sinking parts 14, 15 are arranged in a mirror-inverted manner with respect to one another and—starting from the separation plane 17—have a first shorter hollow-cylindrical section 18, then an adjoining second conical section 19 which tapers at an angle of approximately 45°, and a third longer hollow-cylindrical extension 33 which directly adjoins the second section. Sections 18 and 19 are formed by radial recesses of the sinking 16 which deviate from the contour of the blank 28. The sinking parts 1*e*, 14, 15 are in each case adjoined by a guide bore 20 which penetrate the tool halves 2, 3 coaxially with respect to the sinking axis 21 and into which one punch 22, 23 respectively is received in a slidable manner.

The punches 22, 23 have a central fluid duct 24 which axially penetrates them and by way of which the sinking parts 14, 15 are connected with an externally arranged fluid high pressure generating system. On the side 25 facing the sinking part, the punches 22, 23 are constructed as a conically tapering pin 26, a diagonally extending ring gap 27 forming between the sinking part 14, 15 and the pin 26, in which ring gap 27 the pipe-shaped blank 28 to be formed can be received by the wedge-effect in a locking manner. The receiving device for the blank 28 is therefore formed by the sinking part 14, 15 and by the pin 26, in which case, because of the locking of the blank 28 in the sinking 16 a fluid-high-pressure sealing is achieved with respect to the outside environment. Therefore, in the opening position of the forming tool 1, one end respectively of an entered blank 28 is completely enclosed and held in a pressure-tight manner. On the side 29 of the punch 22, 23 facing away from the sinking part, this punch is connected by way of a punch plate 30, 38 with a hydraulically operating driving cylinder 31, 35 by means of which the punch 22, 23 can be lifted or lowered depending on the use.

It is naturally conceivable to design the receiving device of the blank 28 in the forming tool 1 without a guide bore 20 and a punch 22, 23 so that the base of the tool half 2, 3 adjoining the cylindrical extension 33 of the sinking part 14, 15 and the sinking part 14, 15 itself form the receiving device. Optionally, a receiving pin can be molded to the base corresponding to the construction of the punch 22, 23. This alternative, which is simple with respect to the tools, for providing displaceable punches 22, 23 will only be useful, however, if, after the actual forming of the blank 28, this blank must not be recalibrated, so that a follow-up guiding by punches 22, 23 for maintaining a sufficient sealing will not be required. Likewise, the contact pressure of the completely formed blank 28 in the sinking parts 15, 16 should not be so large that a removal of the bulgingly expanded hollow section 47 created from the blank 28 is prevented because of lacking high removal forces to be applied of a removal device. For this purpose, the removal could, for example, be facilitated by a suitable lubrication between the blank 28 and the sinking part 15, 16.

Figures 3A, 3B, 3C, 3D, 3E, 3F, 3G:
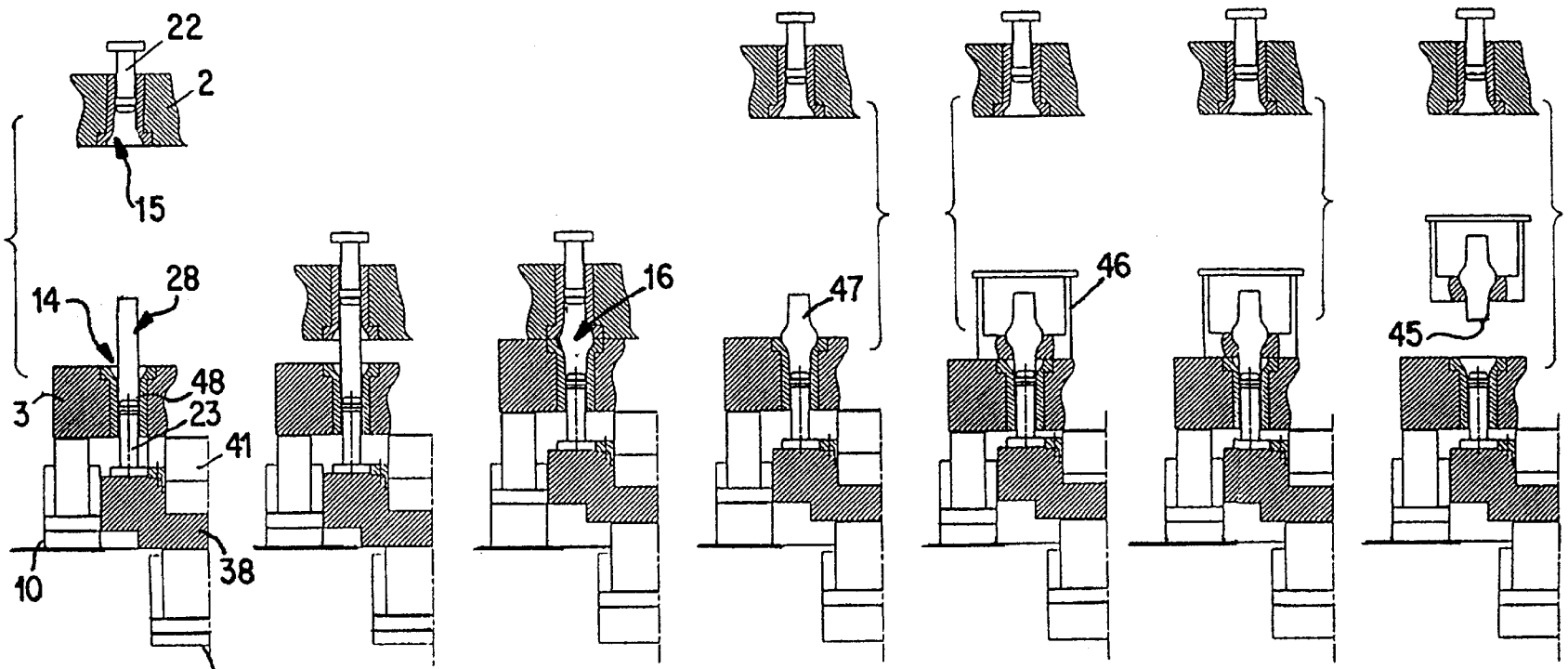
FIGS. 3*a–g* are lateral longitudinal sectional views of the manufacturing sequence of the process according to the invention with the forming tool from FIG. 1 including the removal of the completely formed blank.

For producing hollow sections with a widened crosssection on the end side and with expansions of a high forming degree (>90%), the blank 28 is inserted by means of its lower end 48 in the receiving device of the lower tool half 3 by means of a production robot, in which case the conical section 19 of the sinking part 14 has a centering effect for inserting the blank (FIG. 3*a*). In this case, the press slide 4 together with the upper tool half 2 is in an upper end position. As illustrated in FIG. 2, six die inserts 13 are inserted in a mutual circular arrangement in the lower tool half 3, extend in parallel to one another and correspond to six die inserts 9 in the upper tool half 2. As a result, several blanks 28 can be formed in an economical process simultaneously in one operating cycle and under the same working conditions.

After the insertion of the blank 28 into the receiving device of the lower tool half 3, driven by the press slide 4, the upper tool half 2 is lowered into a catch position (FIG. 3*b*), in which the upper punch 22, which is driven simultaneously with the press slide 4 synchronously by means of the working cylinder 31, is pushed into the upper end 32 of the blank 28 and locks sealingly in the upper receiving device. The catch position is defined by the height of a column-shaped spacing body 34 which, on the one hand, is fixedly anchored on the bedplate 5 and on which, on the other hand, the press slide 4 comes to rest while taking up a position which is stationary during the further manufacturing process. Thus, in the catch position, the upper tool half 2 has reached its lowest lowered position, in which case the press slide 4 applies the required closing force.

Then the lower tool half 3 is lifted by the driving cylinders 10, in which case the lower punch 23, driven by the pertaining lower driving cylinder 35, is lifted synchronously to the lifting of the lower tool half 3. During the lifting, a high pressure is exercised on the blank 28 on the interior side by way of the fluid duct 24. by means of the fluid high pressure generating system, which high pressure starts to expand the blank 28. By the lifting of the lower tool half 3, the blank 28 is simultaneously axially upset, in which case the upsetting capacity if promoted by the expanding effect of the fluid pressure. The process of the expansion upsetting ends when the two tool halves 2, 3 rest against one another; that is, when the closed position of the forming tool 1 is reached (FIG. 1). The formed blank 28 will then rest almost, if not completely on the sinking 6 of the forming tool 1.

In order to achieve a controlled forming, the dependence of the pressure control of the system for generating fluid pressure on the movement control of the lower tool half 3 is absolutely necessary. In this case, the construction of the movement control as a characteristic diagram control with pressure-position value pairs stored in a electronic control unit is useful, in the case of which the pressure value of a momentarily generated fluid pressure is assigned to a position value of the position to be taken up of the lower tool half 3 in the vertical direction into which the lower tool half 3, depending on the preceding position, will then be lifted or lowered. For the implementation, a distance measuring device 36 is provided for the device according to the invention whose distance generator 37 is mounted on the lower tool half, which can carry out strokes, on the one end, and stationarily on the immobile part of the working cylinder 10, on the other end. The distance generator 37 is coupled with the hydraulically operating driving cylinders 10 of the lower tool half 3 such that the desired position values emitted by the characteristic diagram control form a measurement of the intensity and direction of the driving force. Then the actual position of the lower tool half 3 is adapted to the desired position by increasing or decreasing the driving force of the driving cylinders 10.

As an alternative to the above-described control of the lower tool half 3, it is conceivable that this tool half is controlled in its movements by means of preprogrammed driving values stored in the above-mentioned control unit. Then the pressure of the fluid pressure generating system will be controlled, in which case this control is also a characteristic diagram control with position—pressure value pairs stored in the electronic control unit. The control takes place such that a position value which is emitted by the distance measuring device 36 coupled with the driving cylinders 10 of the lower tool half 3 as a function of a momentary drive-specific value, preferably of the driving force, which position value is detected by a sensor and relates to the momentary position of the lower tool half by way of the characteristic diagram, is apportioned to a desired pressure value of the fluid pressure to be generated by the fluid pressure generating system, whereupon the pressure generating system adapts its preceding actual pressure value to the desired pressure value.

After the closing of the forming tool 1, the movement control of the lower tool half 3 is uncoupled from the pressure control. Then, under a high fluid pressure between 800 and 1,000 bar, the preliminary form of the formed blank 28 is calibrated into the final condition, after which it is pressed against the form of the sinking and in the process of which the small radii of the blank 28 are generated (Figure of). Since this is only a slight forming, little wall material must flow in afterwards. It flows under the effect of the fluid pressure by itself to the expansion area with a slight shortening of the cylindrical section of the formed blank 28 corresponding to the cylindrical extensions 33 of the sinking 16. Therefore, no follow-up punch of the known type is required by way of which wall material is supplied afterwards with a high expenditure of force. Because of the also slight relative movement of the blank 28 with respect to the sinking 16, only a light lubrication is required. In principle, it is naturally also conceivable to push in more wall material by means of the punch 22, 23.

In order to ensure the tightness of the blank 28 and of the sinking 16 in the case of the axial shortening of the blank 28, however, a follow-up guiding of the respective punch 22, 23 is required. However, in this case, the punches 22, 23 apply no additional force upsetting the blank 28 but are only displaced along with the shortening movement. The punches 22, 23 are only controlled for the follow-up guiding in the closed position of the forming tool 1 as a function of the calibrating pressure according to a characteristic diagram in a displaceable manner, in that the pressure value of the momentary fluid pressure is assigned to a displacement value for the punch 22, 23 which is transmitted to the punch drive by a distance measuring-system not shown here. For displacing the lower punch 23 relative to the lower tool half 3, a distance cylinder 40 is arranged in the top side 39 of the lower punch plate 38, the piston 41 of the distance cylinder 40 being fastened on the bottom side 42 of the lower tool half 3. By means of the cylinder base 43, the piston 41 bounds a pressure space 44. The alternating effect of the pressure force within the pressure space 44 and the driving force of the driving cylinder 35 define the position of the punch 23 relative to the lower tool half 3. For the follow-up guiding of the punch 23. The pressure within the pressure space 44 is reduced according to the requirements, after which the piston 41 dips deeper into the distance cylinder 40 driven by the driving cylinder 35. The punch 23 is therefore displaced into the sinking part 14. The punch 22 is displaced synchronously to the punch 23 into the sinking part 15 by the corresponding, operating of the driving cylinder 31.

After the calibration has taken place, the fluid pressure is relaxed, after which the press slide 4 with the upper tool half 2 and the punch 22 is lifted into its upper end position and the forming tool 1 is therefore opened. In this case, the completely formed blank 28 is released to the separation plane 17 (FIG. 3*d*). In order to remove the hollow section 47 in a simple manner from the lower sinking part 14, the pressure in the pressure space 44 is lowered further, after which the piston 41 dips still deeper into the distance cylinder 40, whereby, driven by the driving cylinder 35, the punch 23 is displaced farther into the sinking part 14. In this case, it acts axially on the hollow section 47 and displaces it also out of the receiving device until the uppermost displacement position of the punch 23 is reached in which the lower opening edge 45 of the hollow section 47 is arranged in the transition of the hollow-cylindrical extension 33 to the section 19, which is conically expanded from the extension 33, of the sinking part 14 of the lower tool half (FIG. 3*e*). However, positions beyond it are also conceivable. In order to reduce the adhering of the upper tool half 2 on the hollow section 47 in contrast to that of the lower tool half 3, the separation plane 17 of the two tool halves 2, 3 can be displaced to the conical section 19 of the upper sinking part 15, so that the lower sinking part 14 is axially longer than the upper one. In this case, the separation plane 17 does not as previously form the mirror plane between the sinking parts 14, 15.

A robotic removal device equipped with a tong-shape gripper 46 reaches in a form-locking manner below the bulging widening of the hollow section 47 and in the process is supported on the face 11 of the lower tool half 3. Subsequently, the pressure in the pressure space 44 is increased and the driving force of the driving cylinder 35 is simultaneously reduced. In this case, the lower punch plate 38 together with the punch 23 is withdrawn downward, in which case, in that a gripper 46 reaches behind it, the hollow section 47 is stripped off the punch 23 (FIG. 3*f*). Then the hollow section 47 is completely detached from the lower tool half 3 so that the removal of the hollow section 47 can take place (FIG. 3*g*). Instead of using a gripper 46, a removal by means of a suction-cup-equipped robot arm is also conceivable. Finally, the lower tool half 3 is moved back into its lower starting position with a hydraulic pressure relaxation of the driving cylinders 10 by means of its own weight.

At this point, it should be noted that the punch 22, 23 can carry out in a simple manner with respect to the tools and with respect to the working sequence, the function of the sealing-off of the sinking 16 and of the blank 28 as well as of the forming of the receiving device for the blank 28 as well as of the ejection of the completely formed blank 28.

After the removal, the formed blank 28 is separated in the area of its bulging in the center by a cut extending transversely to its longitudinal dimension by means of a suitable separating device, for example, by means of a laser, into two identical hollow sections with a cross-sectionally expanded end. The manufacture of a double part per sinking 16 in one working cycle therefore results in a very high effectiveness and productivity for the forming operation. The described form of the sinking 16 and of the hollow sections are used in a special application as connection stubs for catalyst housings which are welded to them.

As an alternative, the distance cylinder 40 can provide during the forming operation a rigid connection between the lower punch plate 38 and the upper tool half 3. The cylinders 10 are dragged along by the movement of the driving cylinder 35 of the punch 23 serving as the forming cylinder. When the contact position of the two tool halves 2, 3 is reached, the cylinders 10 are acted upon by high pressure in order to hold the forming tool closed during the subsequent calibration operation. In contrast, the distance cylinder 40 is switched to be pressureless so that a follow-up guiding of the punch 23 during the calibration becomes possible in order to be able to maintain the pressure within the sinking 16.

As an alternative to the forming by means of an upper tool half 2 which, on the one hand, is stationary and a lower tool half 3 which, on the other hand, can be moved in strokes, it is conceivable that the lower tool half 3 is arranged in a stationary manner and the upper tool half 2 fixedly connected with the press slide 4 of a forming press can be moved in strokes and can be moved for the forming of the blank 28 onto the lower tool half 3. For this purpose, the spacing body is naturally eliminated. With respect to the control of the press slide 4 in coordination with the fluid high pressure control, the above statements apply. Also, a control is conceivable in the case of which both tool halves 2, 3 can be moved in strokes and can be moved toward one another into the contact position on one another.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A process for manufacturing at least one hollow section having cross-sectional expansions at ends thereof by using a forming tool that consists of two separable halves which form two hollow sections with cross-sectionally widened ends facing one another, comprising the steps of:

widening and simultaneously upsetting at least one hollow blank in a continuous operation with an outside axially directed pressure force before the forming tool is in a closed condition to form a rotationally symmetrical bulging preform which approximates a desired end form of the at least one hollow section, the bulging preform being mirror-symmetrical relative to a transverse center axis of the at least one hollow section; and, in the closed condition of the forming tool, calibrating the formed blank obtained in the expansion upsetting operation with an internal pressure above an internal pressure during the widening and upsetting step to provide a final form of the hollow section pressed completely against sinkings in the two halves of the forming tool.

2. Process according to claim 1, wherein the at least one hollow section is separated in a transverse center relative to a longitudinal dimension of the hollow section after removal from the forming tool in an area of the bulging preform.

3. Process according to claim 1, wherein the step of calibrating includes axially pushing wall material of the at least one blank to a bulging area thereof.

4. Process according to claim 1, wherein the step of widening includes generally a conically widened bulging area on the at least one blank.

5. Process according to claim 4, wherein the at least one hollow section is separated in the bulging area to produce individual similarly shaped hollow sections as connection stubs for catalyst housings.

6. Device for producing at least one hollow section having cross-sectional expansions at ends thereof, comprising an internal high pressure forming tool having two tool halves configured to be relatively movable in a vertical direction and to rest on one another in a closed position, the internal high pressure forming tool having (i) a sinking formed by mutually opposing faces of the two tool halves for entry of at least one hollow oblong blank to be formed and radial recesses that deviate from a contour of the at least one blank, (ii) a fluid pressure generating system for applying a high pressure to widen the at least one blank after introduction of a pressure fluid into the at least one blank (iii) a device for axial fluid-high-pressure-tight sealing of the sinking, and (iv) an externally arranged separating device which, in the area of the widening of the at least one blank, is arranged to separate the at least one blank into two hollow sections with cross-sectionally widened ends, wherein the separation plane of the two tool halves extends transversely to a longitudinal course of the sinking which is configured to be rotationally symmetrically and is spaced away from a centrally extending mirror plane through the radial recesses forming an expansion area of the sinking consisting of two hollow sinking parts to the upper tool half offset in such a manner that it forms a transition from a hollow-cylindrical section of the sinking part starting from the separation plane to a tapered section which adjoins the sinking part;

the two tool halves each have a receiving device in which, in an open position of the forming tool, one end respectively of an entered blank is completely enclosed and held in a pressure-tight manner, the receiving devices being formed by linearly extending hollow-cylindrical extensions of the sinking and by conically constructed ends of one punch respectively which is displaceably guided in a guide bore penetrating the respective tool half and leading out in the sinking part of the tool half by a drive which is separate with respect to the movable tool half; and the device comprising a means for controlling relative movement of the two tools halves, in which pressure control of fluid pressure generating system is correlated with controlling relative movement such that the two tool halves, starting from the open position of the forming tool in a resulting axial upsetting effect onto the blank which simultaneously expands by internal high pressure, approach one another in a continuous movement until a contact position of the two tool halves is reached which forms the closed position of the forming tool in which the movement control is uncoupled from the pressure control, the fluid pressure generating system for the calibration operation of the expansion-upset hollow section being configured to then generate a fluid pressure which is higher than the fluid pressure during the expansion upsetting.

7. Device according to claim 6, wherein a press slide of a forming press is provided to which the tool half constituting an upper tool half is fastened, the press slide being movable onto a spacing body anchored on a bedplate of the forming press, with the upper tool half taking up a catch position in which the inserted at least one blank is held in the receiving device.

8. Device according to claim 6, wherein a drive is provided to which the tool half constituting a lower tool half is provided the drive being separate with respect to the other tool half and configured to move the lower tool half to carry out strokes.

9. Device according to claim 6, wherein one of the two tool halves is a lower tool half having a punch configured to be driven such that, during an approach of the two tool halves until a contact position on one another is reached, the punch always has the same relative position with respect to the lower tool half, and in the contact position can be displaced relative to the position of the lower tool half.

10. Device according to claim 6, wherein a shape of each sinking part corresponds to a conical connection stub for a catalyst.

11. Device according to claim 6, wherein after one of the two tool halves is a lower tool half having a punch and arranged such that, release of an upper end of a completely formed at least one blank resulting from a stroke movement of the other tool half, the punch of the lower tool half is displaceable into the sinking part of the lower tool half that the at least one blank displaced together therewith is grippable by a removal device.

12. Device according to claim 11, wherein, in a gripping position of the removal device, the punch takes up a withdrawal position in a guide bore in which it is uncoupled from an action upon the completely formed blank forming the hollow section.

13. Device according to claim 11, wherein in an uppermost displacement position of the punch, a lower opening edge of the hollow section formed by the formed blank is arranged in a transition of the receiving device for receiving the sinking part of the lower tool half.

14. Device according to claim 6, wherein the forming tool has a plurality of sinkings which are arranged in parallel to one another and have pertaining receiving devices for respective blanks to be inserted therein.

15. Device according to claim 6, wherein the movement control is assigned to a lower tool half, the control being a characteristic diagram control with pressure-position value pairs stored in the electronic control unit, in which the pressure value of a momentarily generated fluid pressure is adapted to a position value of the position of the lower tool half to be taken up in which the lower tool half can be lifted or lowered depending on the position.

16. Device according to claim 15, wherein the device contains a distance measuring device having a distance generator mounted on a lower tool half, which can be moved in strokes on the one end and is stationary mounted on the other end, and which is coupled with the drive of the lower tool half in such a manner that the positional values emitted by the characteristic diagram control form a measurement of the intensity and direction of the driving force.

17. Device according to claim 6, wherein the lower tool half is controlled in its movements by means of preprogrammed driving values stored in the control unit.

18. Device according to claim 17, wherein the pressure control of the fluid pressure generating system is a characteristic diagram control with position—pressure value pairs stored in the electronic control unit, in which case a position value emitted by a distance measuring device coupled with the drive of the lower tool half and emitted as a function of the momentary driving value and related to the momentary position of the tool half is adapted to a desired pressure value of the fluid pressure to be generated by the fluid pressure generating system, to which desired pressure value the pressure generating system adapts its preceding actual pressure value.

19. Device according to claim 6, wherein a lower tool half is arranged in a stationary manner; and the upper tool half which can be moved in strokes and is fixedly connected with a press slide of a forming press can be moved onto the lower tool half for forming the blank.

20. Device according to claim 6, wherein the punches in the closed position of the forming tool as a function of the calibrating pressure can be displaceably controlled such that they can be guided in a follow-up manner corresponding to the expansion-caused shortening of the blank.

* * * * *